US009144267B2

(12) United States Patent
Lo

(10) Patent No.: US 9,144,267 B2
(45) Date of Patent: Sep. 29, 2015

(54) SOLE DEVICE WITH AIR CUSHION FUNCTION

(71) Applicant: Chih-Fang Lo, Taichung (TW)

(72) Inventor: Chih-Fang Lo, Taichung (TW)

( * ) Notice: Subject to any disclaimer, the term of this patent is extended or adjusted under 35 U.S.C. 154(b) by 252 days.

(21) Appl. No.: 13/962,896

(22) Filed: Aug. 8, 2013

(65) Prior Publication Data

US 2015/0040424 A1 Feb. 12, 2015

(51) Int. Cl.
*A43B 13/20* (2006.01)
*A43B 7/08* (2006.01)

(52) U.S. Cl.
CPC ..... *A43B 13/203* (2013.01); *A43B 7/081* (2013.01); *A43B 7/088* (2013.01); *A43B 13/206* (2013.01)

(58) Field of Classification Search
CPC ..... A43B 7/06; A43B 7/08; A43B 7/081; A43B 7/082; A43B 7/084; A43B 7/088
USPC ..... 36/3 B
See application file for complete search history.

(56) References Cited

U.S. PATENT DOCUMENTS

| | | | | | |
|---|---|---|---|---|---|
| 4,071,963 | A * | 2/1978 | Fukuoka | 36/3 B |
| 4,547,978 | A * | 10/1985 | Radford | 36/3 B |
| 5,375,345 | A * | 12/1994 | Djuric | 36/3 B |
| 5,477,626 | A * | 12/1995 | Kwon | 36/3 B |
| 5,505,010 | A * | 4/1996 | Fukuoka | 36/3 B |
| 5,675,914 | A * | 10/1997 | Cintron | 36/3 B |
| 5,845,417 | A * | 12/1998 | Reed et al. | 36/3 B |
| 5,918,381 | A * | 7/1999 | Landry | 36/3 B |
| 5,975,861 | A * | 11/1999 | Shin et al. | 417/234 |
| 6,076,282 | A * | 6/2000 | Brue | 36/3 B |
| 6,085,444 | A * | 7/2000 | Cho | 36/3 B |
| 6,370,799 | B1 * | 4/2002 | Thatcher | 36/3 B |
| 6,370,800 | B1 * | 4/2002 | Hung | 36/3 B |
| 6,463,679 | B1 * | 10/2002 | Buttigieg | 36/3 B |
| 6,625,902 | B2 * | 9/2003 | Yamamoto | 36/3 B |
| 6,775,926 | B1 * | 8/2004 | Huang | 36/3 B |
| 6,948,260 | B2 * | 9/2005 | Lin et al. | 36/3 B |
| 7,210,249 | B2 * | 5/2007 | Passke et al. | 36/29 |
| 7,254,903 | B2 * | 8/2007 | Cho et al. | 36/3 R |
| 7,331,121 | B2 * | 2/2008 | Lo | 36/3 R |
| 7,426,793 | B2 * | 9/2008 | Crary | 36/29 |
| 7,546,696 | B1 * | 6/2009 | Acheson et al. | 36/29 |
| 7,624,515 | B2 * | 12/2009 | Kita et al. | 36/30 R |
| 7,681,329 | B2 * | 3/2010 | Fu | 36/3 B |
| 8,555,526 | B2 * | 10/2013 | Elnekaveh | 36/27 |
| 8,806,782 | B2 * | 8/2014 | Sun | 36/102 |
| 8,893,403 | B2 * | 11/2014 | Mohlmann | 36/3 R |
| 2002/0189131 | A1 * | 12/2002 | Chang | 36/3 B |
| 2004/0261293 | A1 * | 12/2004 | Marvin et al. | 36/29 |
| 2005/0198858 | A1 * | 9/2005 | Hsu | 36/3 A |
| 2006/0117599 | A1 * | 6/2006 | Deem et al. | 36/3 B |
| 2006/0196081 | A1 * | 9/2006 | Lee | 36/29 |
| 2007/0068037 | A1 * | 3/2007 | Ridinger | 36/3 B |
| 2007/0094890 | A1 * | 5/2007 | Cho et al. | 36/3 B |
| 2007/0209233 | A1 * | 9/2007 | Kim et al. | 36/27 |
| 2007/0294916 | A1 * | 12/2007 | Park | 36/29 |
| 2008/0163517 | A1 * | 7/2008 | Chen | 36/3 B |

(Continued)

*Primary Examiner* — Richale Quinn
*Assistant Examiner* — Anne Kozak

(57) ABSTRACT

A sole device with air cushion function includes a sole body having a receiving space and a sealing film, the sealing film sealing the receiving space, the sole body having a plurality of supporters formed at a top side thereof; and an air valve set assembled in the receiving space, the air valve set having a main valve, a sub valve and at least one air duct. Under this arrangement, the air flows into the sole body via the air valve set and a motion of a foot of a user.

6 Claims, 12 Drawing Sheets

(56) References Cited

U.S. PATENT DOCUMENTS

| | | | | |
|---|---|---|---|---|
| 2008/0209770 | A1* | 9/2008 | Boone et al. | 36/3 R |
| 2009/0019726 | A1* | 1/2009 | Gornatti | 36/29 |
| 2009/0083995 | A1* | 4/2009 | Hsieh et al. | 36/29 |
| 2009/0095358 | A1* | 4/2009 | Christensen et al. | 137/224 |
| 2009/0151203 | A1* | 6/2009 | Boyer et al. | 36/3 B |
| 2009/0282704 | A1* | 11/2009 | Park | 36/3 B |
| 2011/0047830 | A1* | 3/2011 | Francello et al. | 36/134 |
| 2011/0265352 | A1* | 11/2011 | Lin | 36/3 B |
| 2012/0110875 | A1* | 5/2012 | Dominguez Irisarri | 36/3 B |
| 2012/0255198 | A1* | 10/2012 | Langvin et al. | 36/29 |
| 2013/0213147 | A1* | 8/2013 | Rice et al. | 73/862.046 |
| 2013/0326912 | A1* | 12/2013 | Lindsay et al. | 36/103 |
| 2014/0068973 | A1* | 3/2014 | Krupenkin et al. | 36/136 |
| 2014/0165427 | A1* | 6/2014 | Molyneux et al. | 36/102 |
| 2015/0040425 | A1* | 2/2015 | Adams | 36/29 |

* cited by examiner

SOLE DEVICE WITH AIR CUSHION FUNCTION

BACKGROUND OF THE INVENTION

1. Field of the Invention

The present invention relates to a sole device, and more particularly to a sole device with air cushion function.

2. Description of Related Art

Referring to FIGS. 1A-2B, a conventional sole device with air cushion function comprises a sole body, a plurality of first supporters A1 and a plurality of second supporters A2. Each first supporter A1 is extended from the sole body toward a foot of a user. A space with air is defined between the first supporters A1. Clearly, each first supporter A1 and each second supporter A2 are crossed with each other, so as to support the foot. However, the first supporters A1 or the second supporters A2 are usually made of hard rubber so as to stably support the foot; as a result, after long-term use, the supporters would be deformed or sunken. Therefore, the conventional sole device with air cushion function would make the user uncomfortable, after long-term use. In order to overcome said issue, another conventional sole device with air cushion function comes to the world.

Referring to FIGS. 3A-3B, another conventional sole device with air cushion function comprises a receiving space formed therein. The receiving space is stuffed with an EVA (Ethylene Vinyl Acetate) material so as to define an EVA layer A3. However, after long-term use, an elasticity of the EVA layer A3 would be decayed. In order to overcome said issue, another conventional sole device with air cushion function comes to the world.

Referring to FIGS. 4A-4B, another conventional sole device with air cushion function comprises a sole body having a plurality of supporting ribs A4. A buffer groove A5 is defined in each supporting rib A4, so as to provide a buffer for each supporting rib A4 when each supporting rib A4 is compressed. Referring to FIG. 4B, a cross-sectional area of the buffer groove A5 is hammer-shaped. However, an elasticity of each supporting rib A4 is still limited; in addition, because of the buffer groove A5 each supporting rib A4 is hollow, so that each supporting rib A4 is flabby. In order to overcome said issue, the other conventional sole device with air cushion function comes to the world.

The other conventional sole device with air cushion function comprises a sole body. The sole body is made of anti-friction material. A plurality of posts is defined at a front end of the sole body. A plurality of posts is defined at a rear end of the sole body. A hexagonal area is defined at a portion of the sole body which is corresponding to an inner side of the foot. The hexagonal area is made of anti-friction material or anti-skid material. An outer periphery is made of anti-friction material. Therefore, the whole sole body is anti-friction material and anti-skid. However, although the sole body is anti-friction material and anti-skid, the sole body would make the user uncomfortable; in addition, an elasticity of the sole body would be decayed.

Furthermore, referring to said conventional sole devices, the air is not flowable in the sole body, so that the user would be uncomfortable.

The present invention has arisen to mitigate and/or obviate the disadvantages of the conventional sole devices.

SUMMARY OF THE INVENTION

The main objective of the present invention is to provide an improved sole device.

To achieve the objective, a sole device with air cushion function comprises a sole body being elastic, the sole body having a receiving space being open, the sole body having a sealing film, the sealing film sealing the receiving space, the sole body having a plurality of supporters formed at a top side thereof, the sole body and the supporters formed as one piece, the supporters extended from a bottom side of the sole body to the receiving space at the top side of the sole body, each supporter having a bottom groove defined therein, each supporter having an inner wall and an outer wall, the outer wall of each supporter abutting against the sealing film at one end thereof; and an air valve set assembled in the receiving space, the air valve set having a main valve, a sub valve and at least one air duct, the main valve and the sub valve in the receiving space spaced from each other, so as to define a first air chamber, a second air chamber and an air admission room located between the first air chamber and the second air chamber, one of the main valve and the sub valve having an air admission pipe and an air exhaust pipe, another of the main valve and the sub valve having a sub air exhaust pipe, the air admission pipe communicating with the air admission room and the first air chamber, or the air admission pipe communicating with the air admission room and the second air chamber, the air duct connected to the air exhaust pipe at one end thereof, another end of the air duct connected to the sub air exhaust pipe, so as to make the air flowable between the first air chamber and the second air chamber. Wherein, the supporters at the first air chamber are defined as springs; the main valve further has an air jet pipe; the sub valve further has a sub air jet pipe; an air ejection pipe is assembled at one supporter in the second air chamber; the sole body further has an air bleeding pipe; the air bleeding pipe communicates with the air jet pipe, the sub air jet pipe and the air ejection pipe, so that the air in the sole body exhausts from the sole body; the air jet pipe, the sub air jet pipe and the air ejection pipe are one-way valves; the air exhaust pipe and the sub air exhaust pipe are both two-way valves or are both one-way valves; one end of each supporter abuts against the sealing film and is defined as a flat surface; the sole body and the supporters are made of rubber material.

Under this arrangement, the air flows into the first air chamber and the second air chamber via the air admission pipe and a motion of a foot.

Further benefits and advantages of the present invention will become apparent after a careful reading of the detailed description with appropriate reference to the accompanying drawings.

DETAILED DESCRIPTION OF THE INVENTION

Figure 1A:
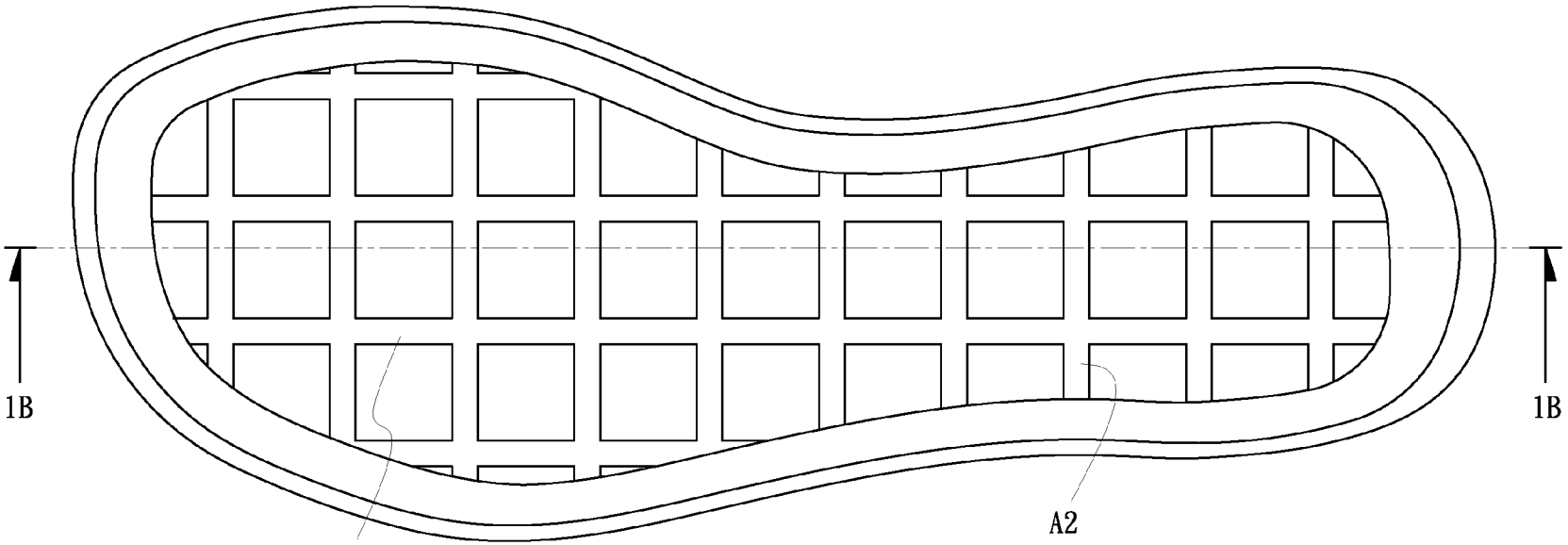
FIG. 1A (Prior art)
FIG. 1A is a top plan view of a conventional sole device.
Figure 1B:
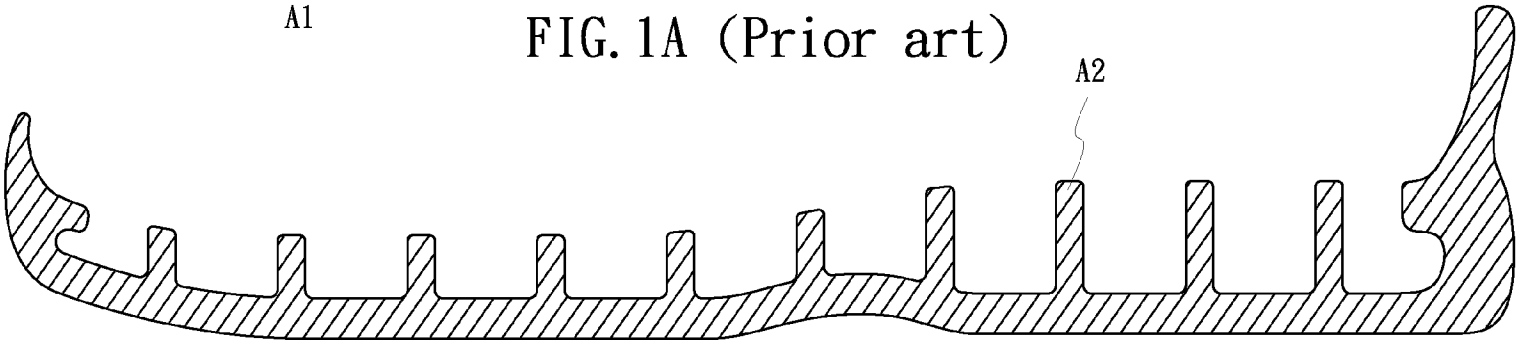
FIG. 1B (Prior art)
FIG. 1B is a cross-sectional view of the conventional sole device along line 1B-1B of FIG. 1A.
Figure 2A:
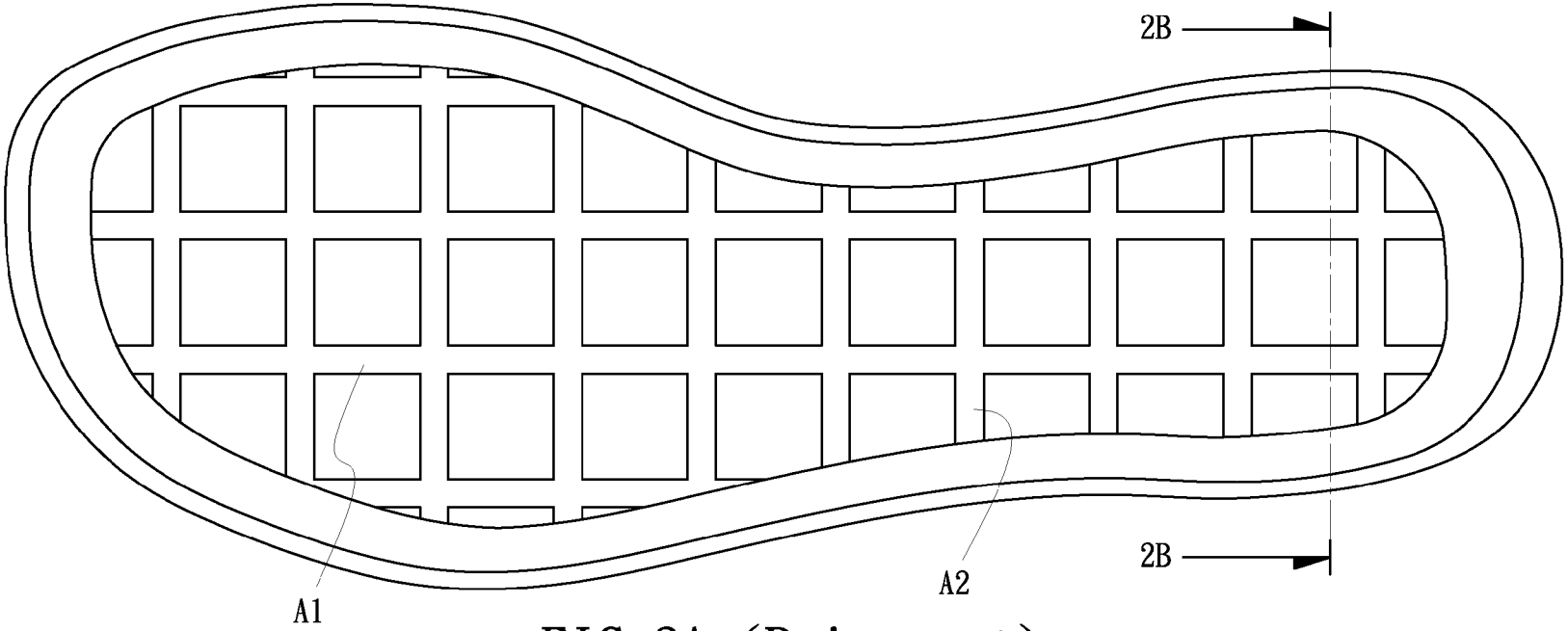
FIG. 2A (Prior art)
FIG. 2A is the top plan view of the conventional sole device.
Figure 2B:
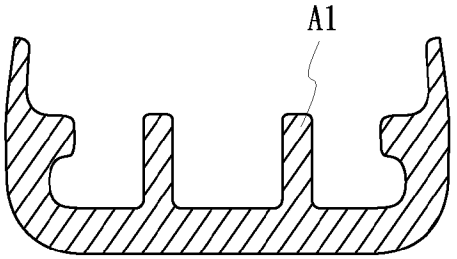
FIG. 2B (Prior art)
FIG. 2B is a cross-sectional view of the conventional sole device along line 2B-2B of FIG. 2A.
Figure 3A:
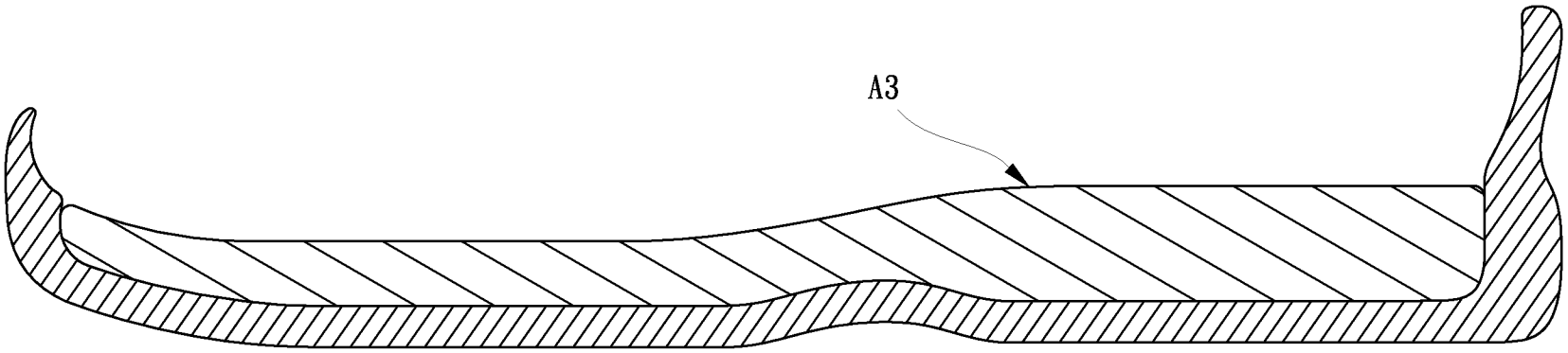
FIG. 3A (Prior art)
FIG. 3A is a cross-sectional view of another conventional sole device.
Figure 3B:
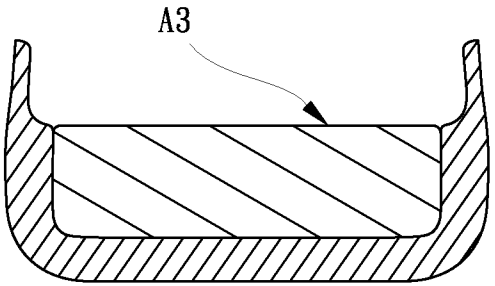
FIG. 3B (Prior art)
FIG. 3B is another cross-sectional view of another conventional sole device.
Figure 4A:
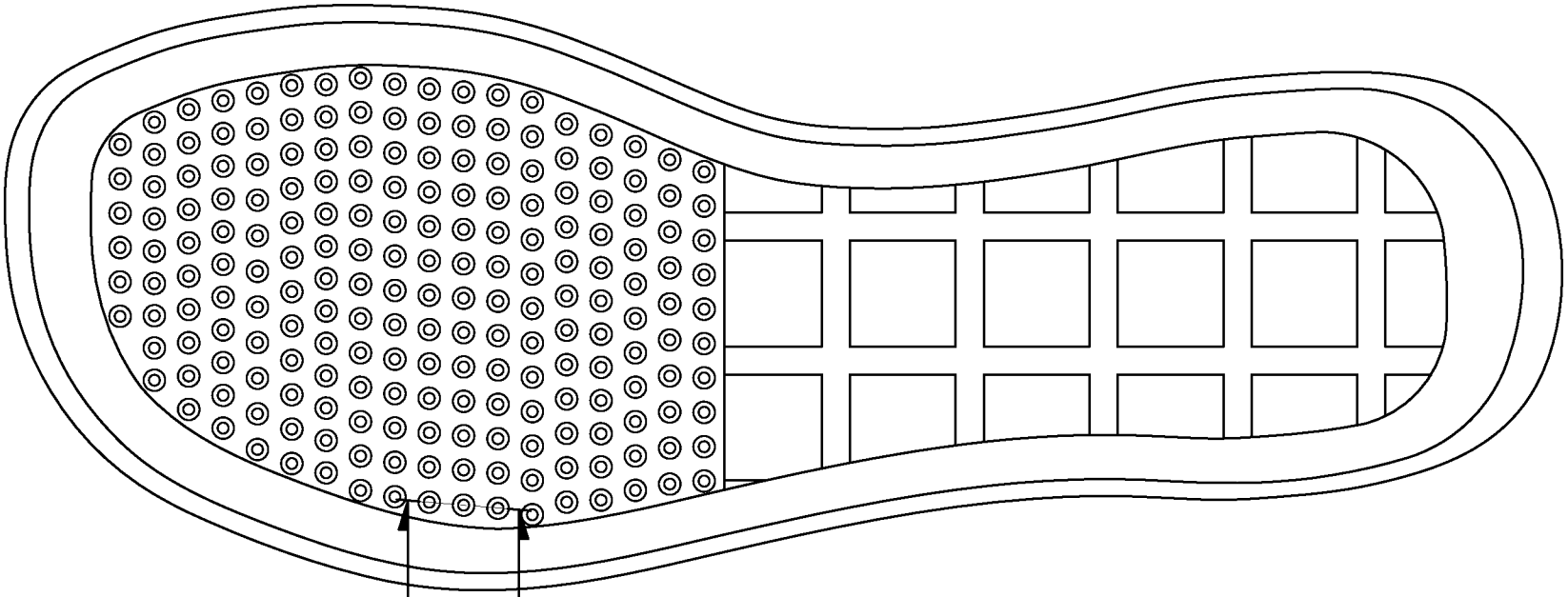
FIG. 4A (Prior art)
FIG. 4A is a top plan view of the other conventional sole device.
Figure 4B:
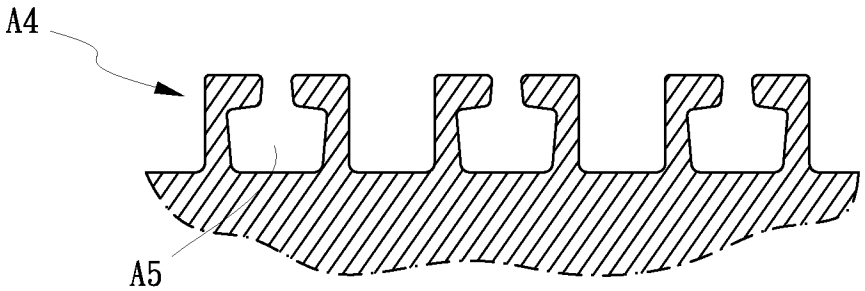
FIG. 4B (Prior art)
FIG. 4B is a cross-sectional view of the other conventional sole device along line 4B-4B of FIG. 4A.
Figure 5:
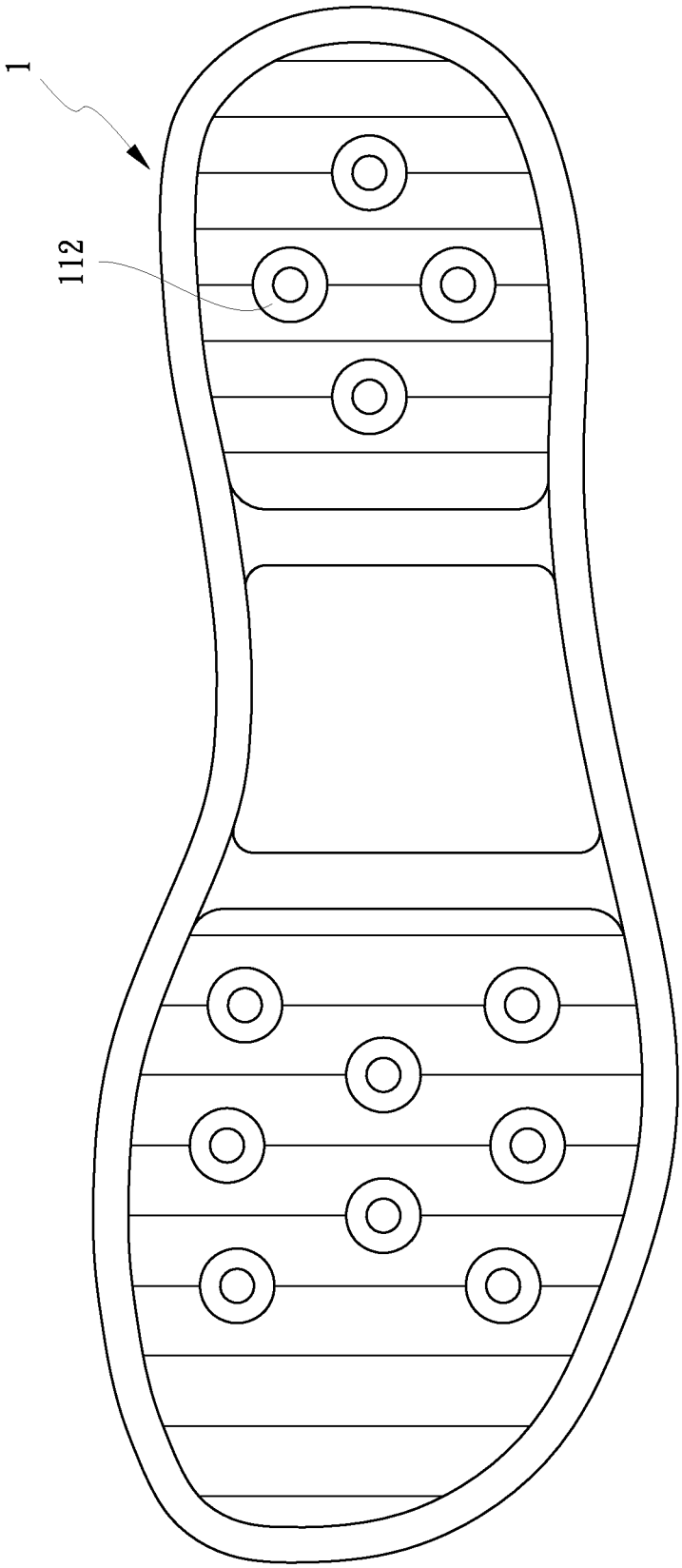
FIG. 5 is a top plan view of the first embodiment of the present invention.
Figure 6:
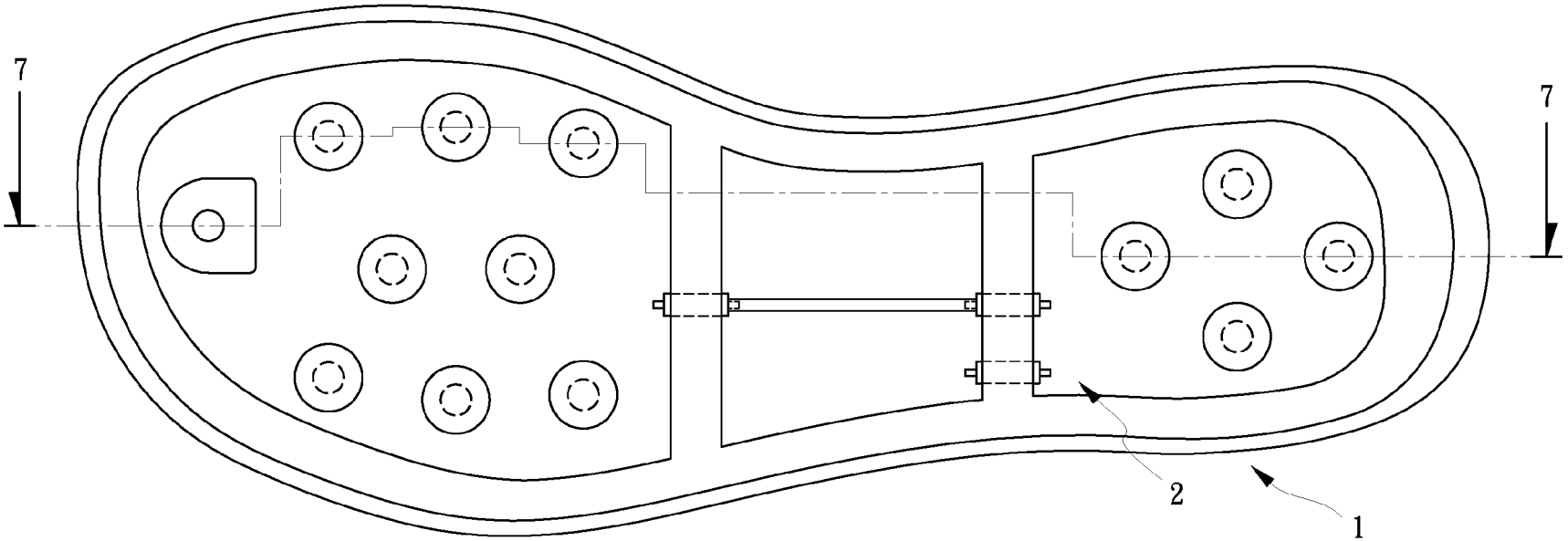
FIG. 6 is the top plan view of the first embodiment of the present invention.
Figure 7:
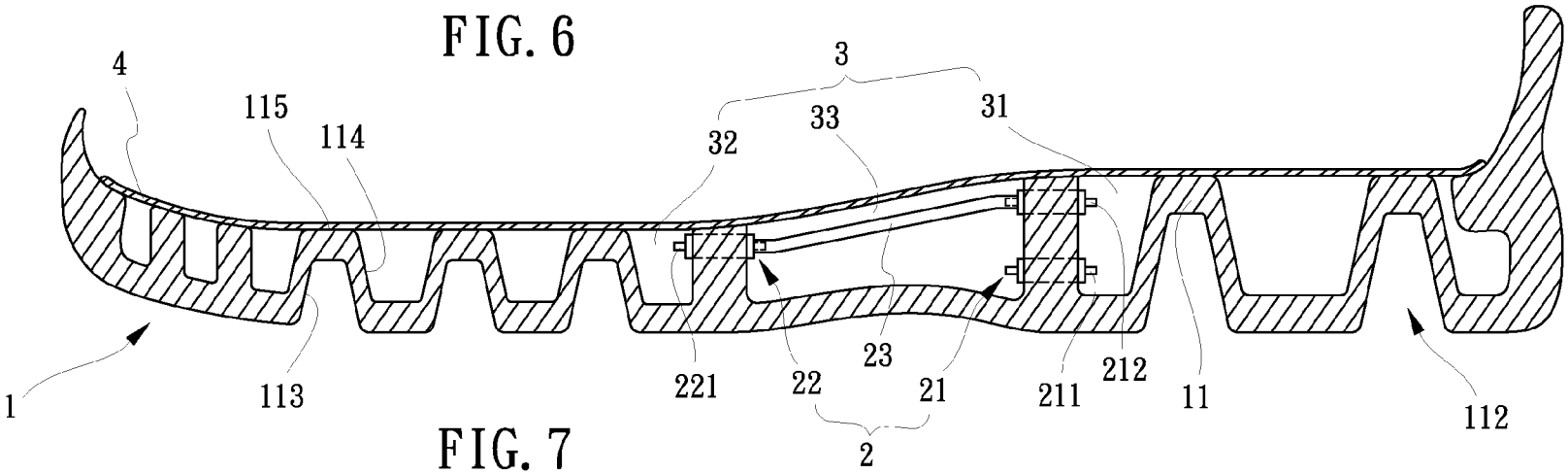
FIG. 7 is a cross-sectional view of the first embodiment along line 7-7 of FIG. 6.
Figure 8:
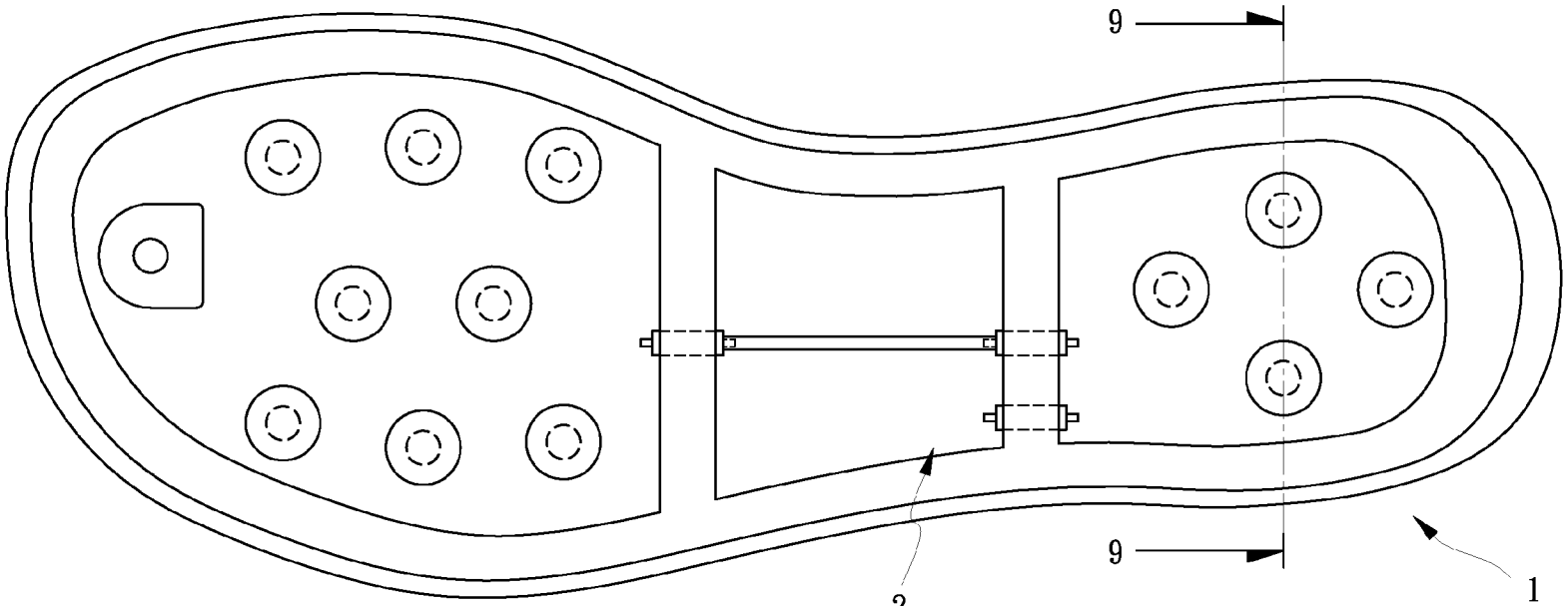
FIG. 8 is the top plan view of the first embodiment of the present invention.
Figure 9:
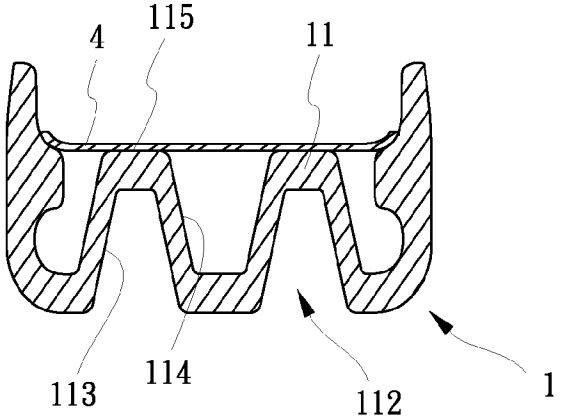
FIG. 9 is a cross-sectional view of the first embodiment along line 9-9 of FIG. 8.

Referring to FIGS. 5-9, a sole device with air cushion function in accordance with the present invention comprises a sole body 1 and an air valve set 2. The sole body 1 is made of rubber material and is elastic. The sole body 1 has a receiving space 3 being open. The sole body 1 has a sealing film 4. The sealing film 4 seals the receiving space 3. The sole body 1 has a plurality of supporters 11 formed at a top side thereof. The sole body 1 and the supporters 11 are formed as one piece, so that the supporters 11 are also made of rubber material. The supporters 11 are extended from a bottom side of the sole body 1 to the receiving space 3 at the top side of the sole body 1. Each supporter 11 has a bottom groove 112 defined therein. Each supporter 11 has an inner wall 113 and an outer wall 114. The outer wall 114 of each supporter 11 abuts against the sealing film 4 at one end thereof. One end of each supporter 11 abuts against the sealing film 4 and is defined as a flat surface 115 so that an abutment between each supporter 11 and the sealing film 4 is stable even if a foot steps on the sealing film 4 of the sole body 1.

The air valve set 2 is assembled in the receiving space 3. The air valve set 2 has a main valve 21, a sub valve 22 and at least one air duct 23. The main valve 21 and the sub valve 22 in the receiving space 3 are spaced from each other, so as to define a first air chamber 31, a second air chamber 32 and an air admission room 33 located between the first air chamber 31 and the second air chamber 32. Two portions of the sealing film 4, which respectively correspond to the first air chamber 31 and the second air chamber 32, are both defined as air impermeable portions 12. Another portion of the sealing film 4, which corresponds to the air admission room 33, is defined as an air admission portion 13. The main valve 21 has an air admission pipe 211 and an air exhaust pipe 212. The sub valve 22 has a sub air exhaust pipe 221. The air admission pipe 211 communicates with the air admission room 33 and the first air chamber 31, or the air admission pipe 211 communicates with the air admission room 33 and the second air chamber 32. The air duct 23 is connected to the air exhaust pipe 212 at one end thereof. Another end of the air duct 23 is connected to the sub air exhaust pipe 221. The air exhaust pipe 212 and the sub air exhaust pipe 221 are both two-way valves or are both one-way valves. The air admission pipe 211 is a one-way valve in the first embodiment.

Under this arrangement, when a heel of a user is moved up from a ground, air flows into the air admission room 33 via the air admission portion 13; as a result, the air in the air admission portion 13 flows into the first air chamber 31 via the air admission pipe 211, so that the first air chamber 31 is full of the air and an air pressure of the first air chamber 31 is increased. In contrast, when the user treads on the sole body 1 with the heel thereof, the air of the first air chamber 31 is compressed; then, the air flows into the second air chamber 32 via the air exhaust pipe 212, the air duct 23 and the sub air exhaust pipe 221; as a result, an air pressure of the second air chamber 32 is increased. Therefore, before the user treads on the sole body 1 with the heel thereof, the first air chamber 31 is always full of the air, so as to provide a stable foundation for the heel of the user; in addition, the air is flowable in the sole body 1, so as to make the user comfortable.

The detail of the first embodiment is described as following.

Figure 10:
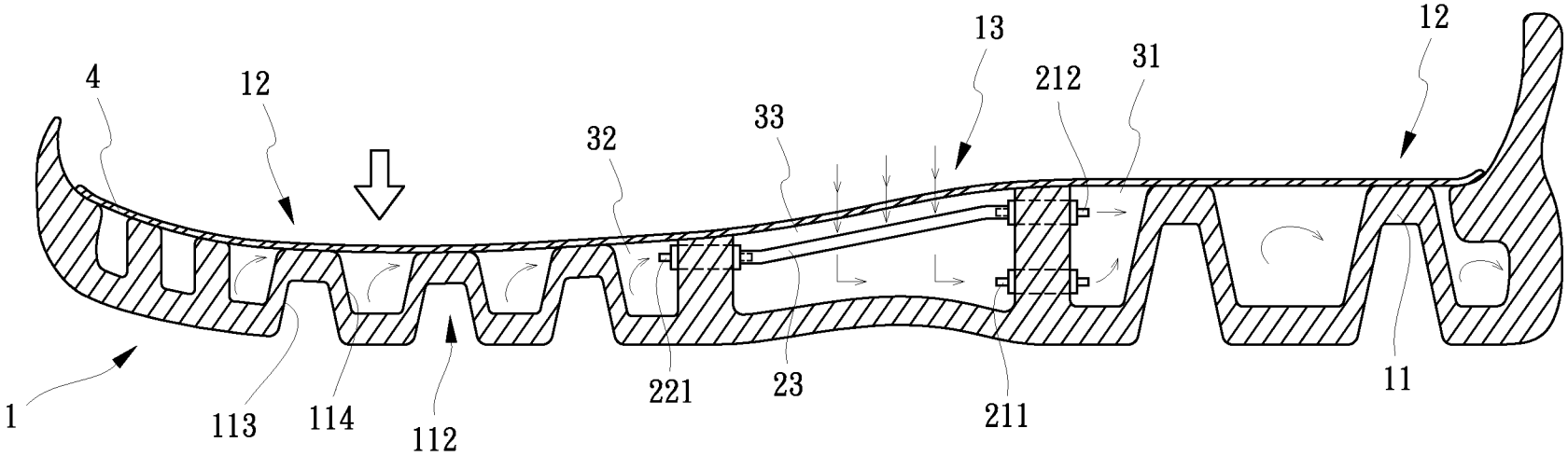
FIG. 10 is a cross-sectional view of the first embodiment for showing a plurality of supporters compressed at a front end of a sole body.
Figure 11:
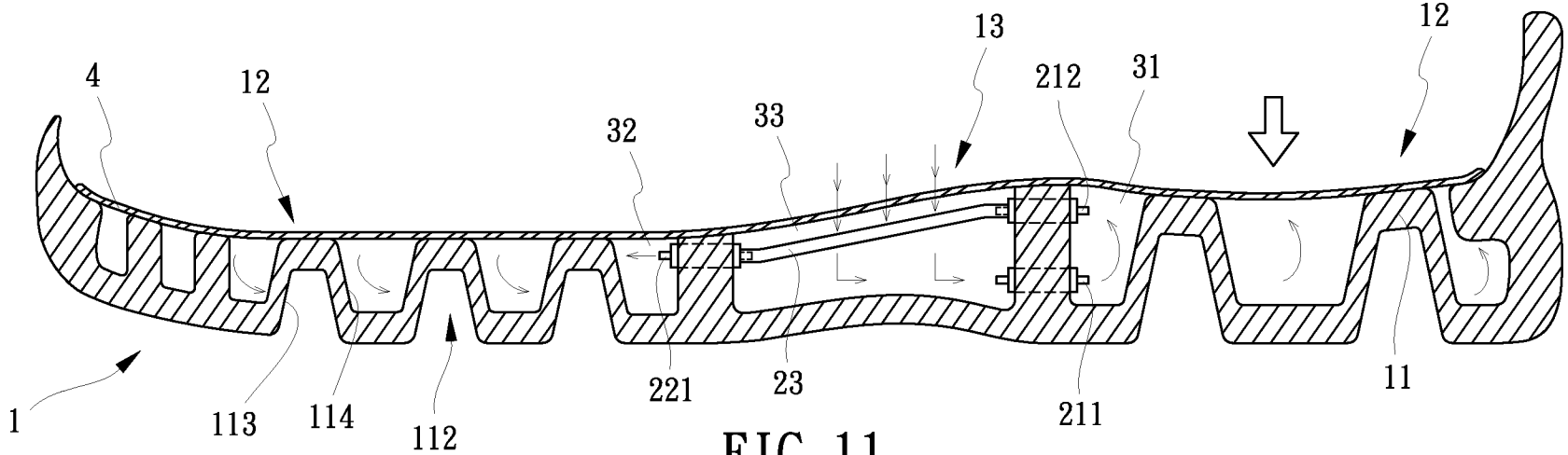
FIG. 11 is a cross-sectional view of the first embodiment for showing the supporters compressed at a rear end of the sole body.

Referring to FIG. 10, when a front end of the sole body 1 is trodden by a tiptoe of the user, the supporters 11 at the front end of the sole body 1 are compressed. Referring to FIG. 11, when a rear end of the sole body 1 is trodden by the heel of the user, the supporters 11 at the rear end of the sole body 1 are compressed. When the supporters 11 at the front end or the rear end of the sole body 1 are compressed downwardly, the supporters 11 are radially expanded because of the flexibility thereof. There is enough space around each supporter 11 for each supporter 11 to be radially expanded.

Figure 17:
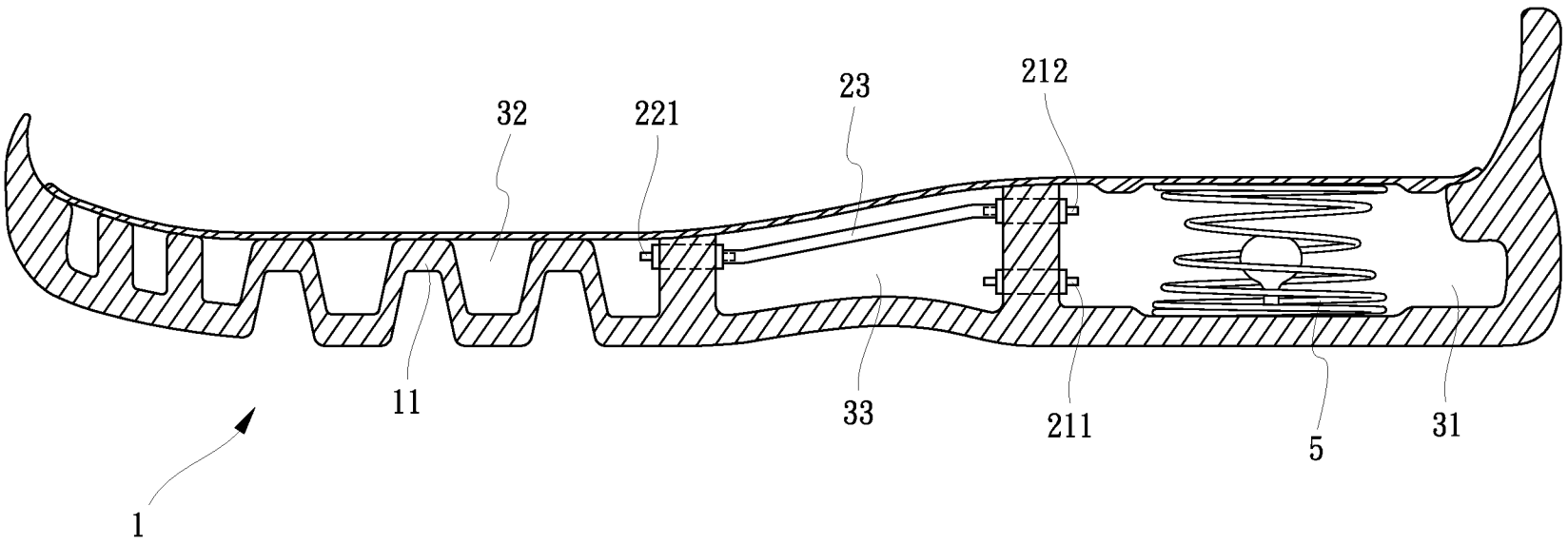
FIG. 17 is a cross-sectional view of the fifth embodiment of the present invention.

The supporters 11 at the first air chamber 31 are defined as springs 5 or other elastic members in other embodiment (as shown in FIG. 17).

Figure 12:
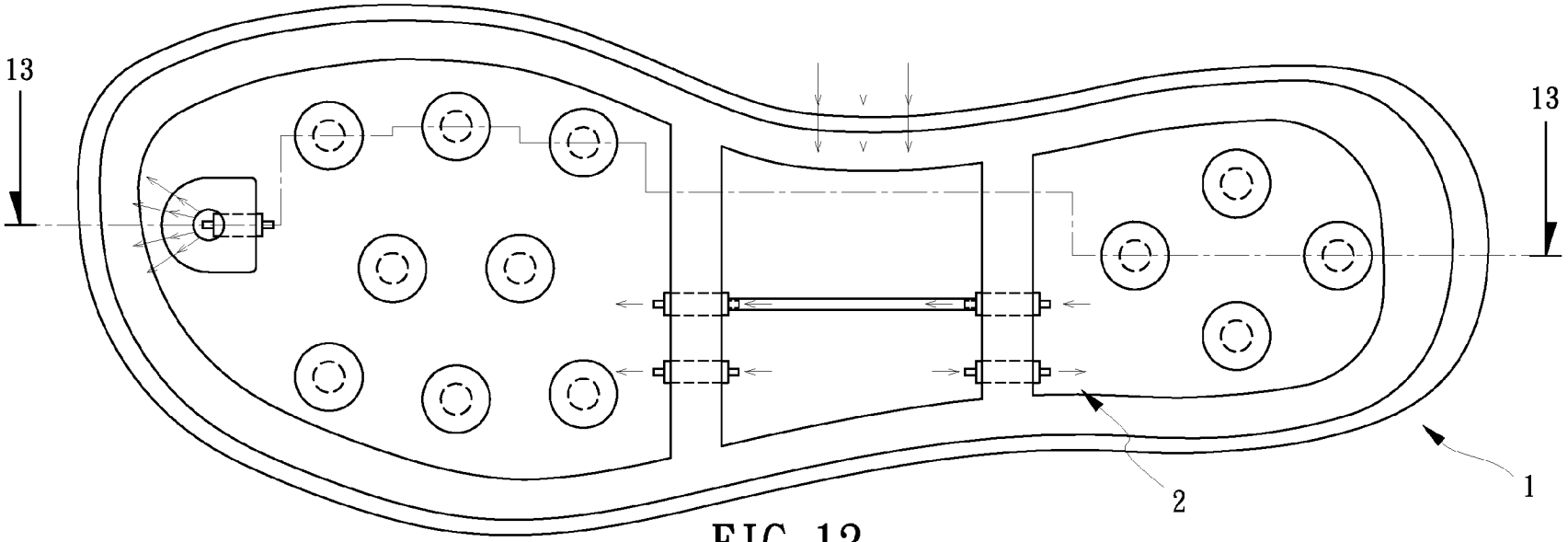
FIG. 12 is a top plan view of the second embodiment of the present invention.
Figure 13:
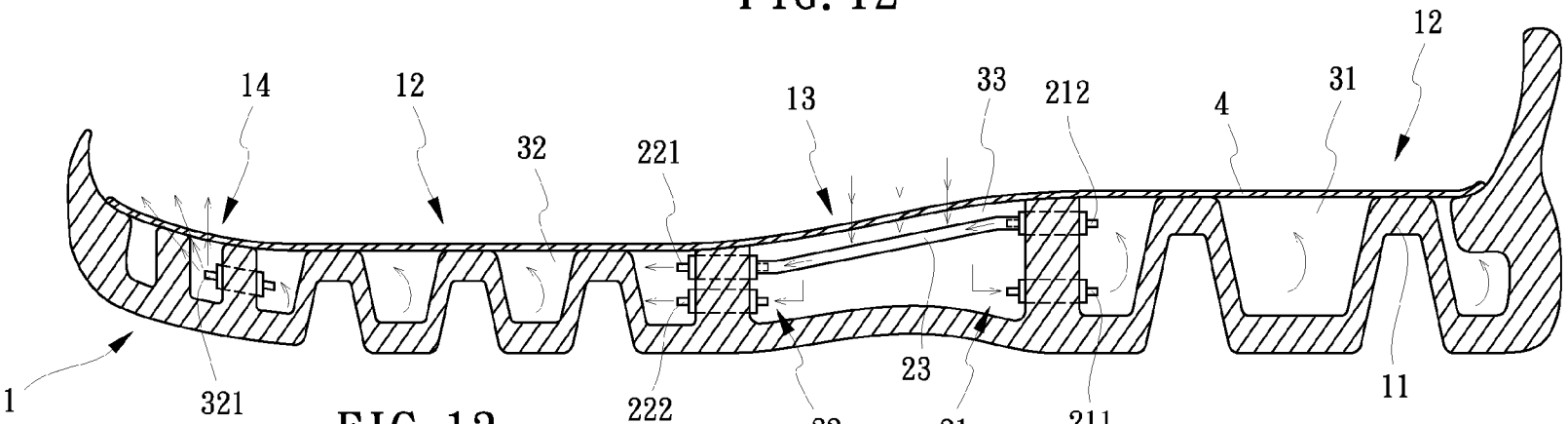
FIG. 13 is a cross-sectional view of the second embodiment along line 13-13 of FIG. 12.

Referring to FIG. 12-13, the second embodiment of the present invention is described as following (only the differences between the first embodiment and the second embodiment are further described). The sub valve 22 further has a sub air jet pipe 222. An air ejection pipe 321 is assembled at one supporter 11 in the second air chamber 32. A further portion of the sealing film 4, which corresponds to the air ejection pipe 321, is defined as an air permeable portion 14. The sub air jet pipe 222 communicates with the air admission room 33 and the second air chamber 32. When the front end of the sole body 1 is trodden by the tiptoe of the user or the rear end of the sole body 1 is trodden by the heel of the user, the air in the first air chamber 31 or the second air chamber 32 is compressed; then, the air in the first air chamber 31 or the second air chamber 32 is ejected via the air ejection pipe 321; thereafter, the air flows out from the sole body 1 via the air permeable portion 14; as a result, the air in the first air chamber 31 or the second air chamber 32 smoothly exhausts. In contrast, when the foot of the user is moved up from the ground, the air outside the sole body 1 flows into the sole body 1, so that the first air chamber 31 or the second air chamber 32 is full of the air and the air pressure of the first air chamber 31 or the second air chamber 32 is increased. Therefore, the present invention provides the stable foundation for the foot of the user; in addition, the air is flowable in the sole body 1, so as to make the user comfortable.

Figure 14:
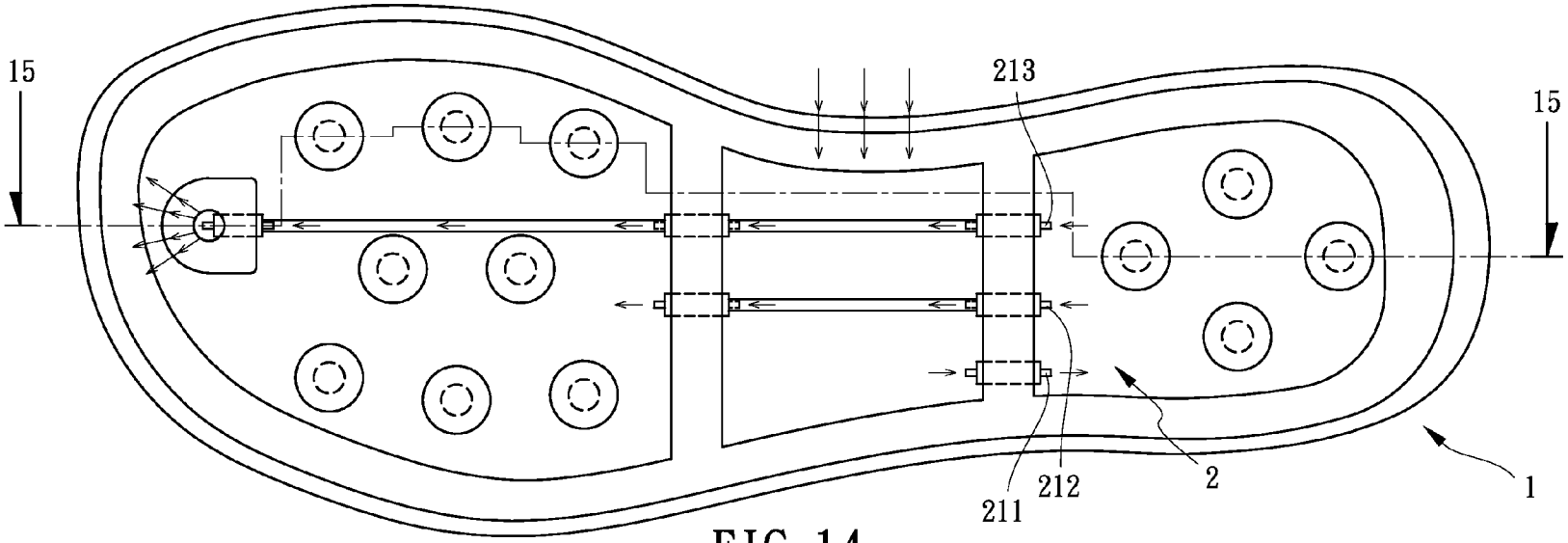
FIG. 14 is a top plan view of the third embodiment of the present invention.
Figure 15:
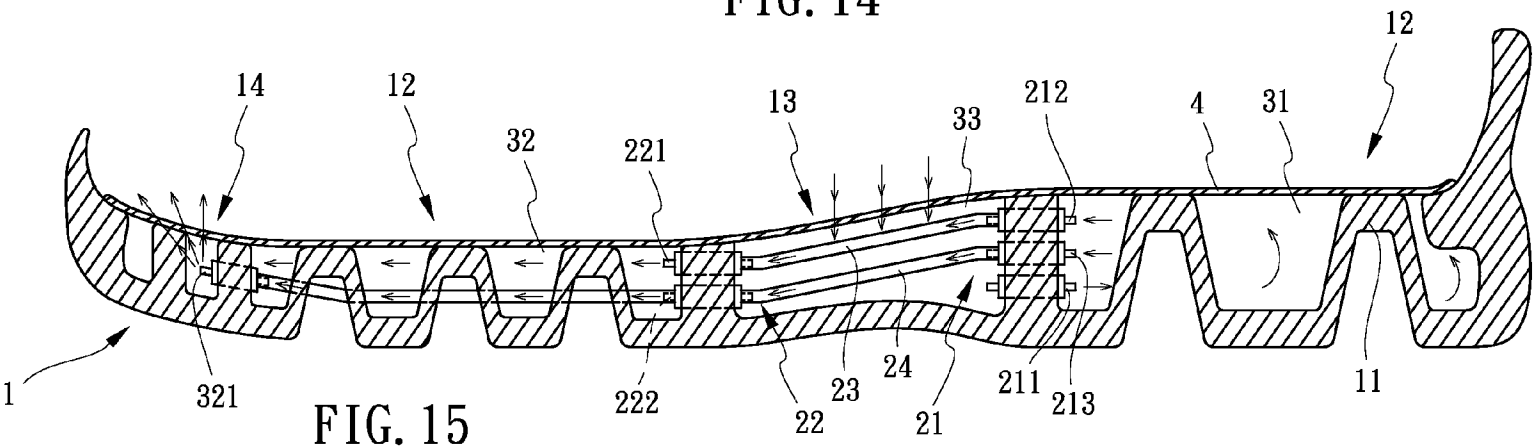
FIG. 15 is a cross-sectional view of the third embodiment along line 15-15 of FIG. 14.

Referring to FIGS. 14-15, the third embodiment of the present invention is described as following (only the differences between the second embodiment and the third embodiment are further described). The sole body 1 further has an air bleeding pipe 24. The main valve 21 further has an air jet pipe 213. The air bleeding pipe 24 communicates with the air jet pipe 213, the sub air jet pipe 222 and the air ejection pipe 321. When the rear end of the sole body 1 is trodden by the heel of the user, the air in the first air chamber 31 is compressed; then, the air in the first air chamber 31 flows into the second air chamber 32 via the air duct 23 until the second air chamber 32 is full of air; thereafter, the remaining air in the first air chamber 31 flows to the air ejection pipe 321 via the air bleeding pipe 24; as a result, the air from the air ejection pipe 321 exhausts from the air permeable portion 14. In contrast, when the front end of the sole body 1 is trodden by the tiptoe of the user, the air flows into the air admission room 33 via the air admission portion 13; as a result, the air in the air admission portion 13 flows into the first air chamber 31, so that the first air chamber 31 is full of the air and an air pressure of the first air chamber 31 is increased.

Figure 16:
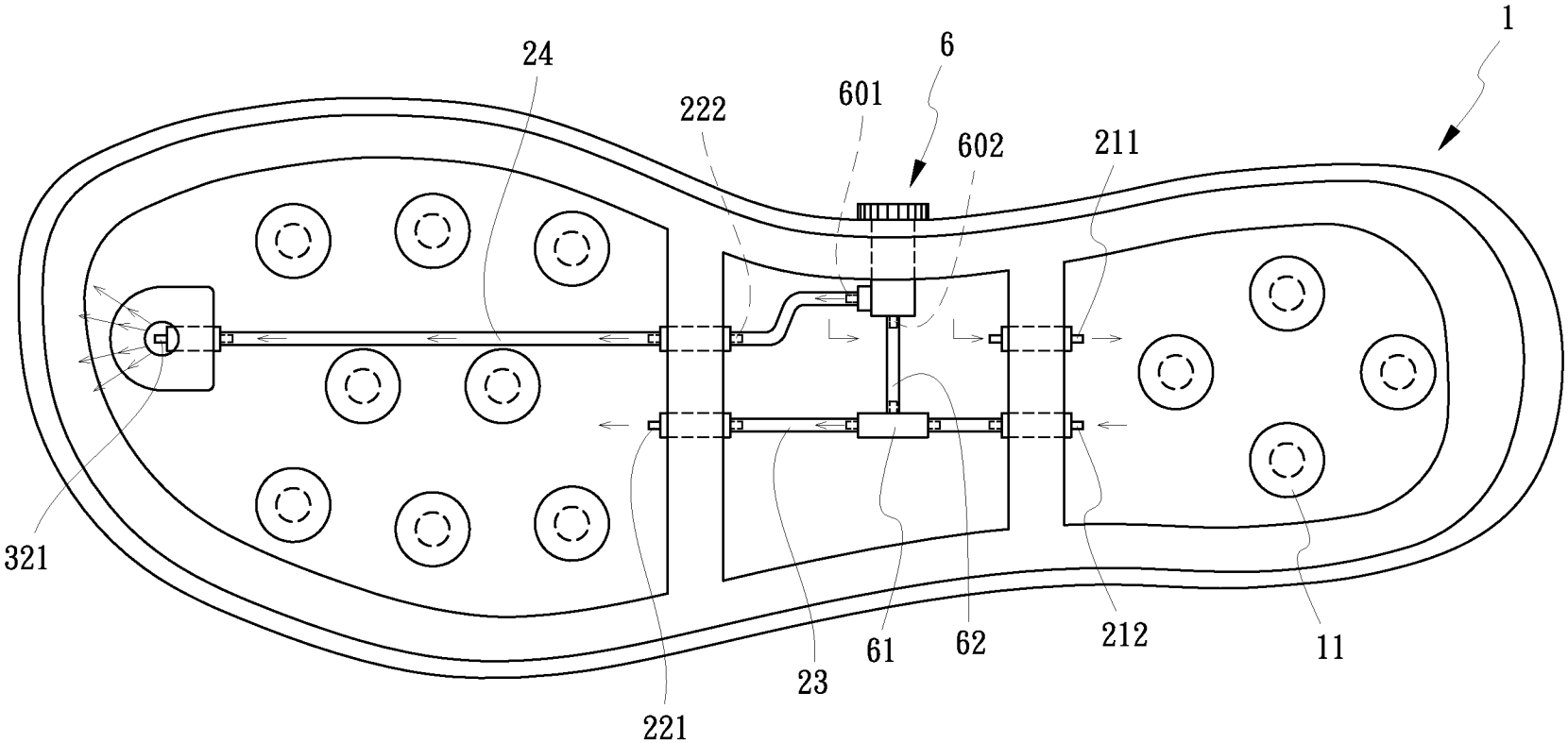
FIG. 16 is a top plan view of the fourth embodiment of the present invention.

Referring to FIG. 16, the fourth embodiment of the present invention is described as following (only the differences between the fourth embodiment and the third embodiment are further described). The sole body 1 further has a controller 6 and a perforated pipe 61. The controller 6 has an air pipe 601 assembled at an outer periphery thereof, and a sub air pipe 602 assembled at a bottom end thereof. The air pipe 601 communicates with the air bleeding pipe 24, the sub air jet pipe 222 and the air ejection pipe 321. The sole body 1 further has a connecting pipe 62 which connects the sub air pipe 602 and the perforated pipe 61. The perforated pipe 61 communicates with the air duct 23, the air exhaust pipe 212 and the sub air exhaust pipe 221. A predefined air pressure is defined via the controller 6. The second air chamber 32 communicates with the perforated pipe 61, the controller 6 and the air pipe 601.

Under this arrangement, when the rear end of the sole body 1 is trodden by the heel of the user, the air in the first air chamber 31 is compressed; then, the air in the first air chamber 31 flows into the second air chamber 32 via the perforated pipe 61, the air exhaust pipe 212 and the sub air exhaust pipe 221, so that the air pressure of the second air chamber 32 is increased until the air pressure of the second air chamber 32 is higher than the predefined air pressure; thereafter, when the air pressure of the second air chamber 32 is larger than the predefined air pressure, the air in the second air chamber 32 flows to the controller 6 via the connecting pipe 62 and flows to the sub air jet pipe 222 via the air bleeding pipe 24; finally, the air flows to the air ejection pipe 321 so as to exhaust. In addition, when the air pressure of the second air chamber 32 or the first air chamber 31 is not enough, the air flows into the sole body 1 via a motion of the foot, so as to increase the air pressure of the second air chamber 32 or the first air chamber 31. Furthermore, the user can adjust the predefined air pressure of the air chambers.

Furthermore, the air jet pipe 213, the sub air jet pipe 222 and the air ejection pipe 321 are one-way valves.

Although the invention has been explained in relation to its preferred embodiment, it is to be understood that many other possible modifications and variations can be made without departing from the scope of the invention as hereinafter claimed.

What is claimed is:

1. A sole device with air cushion function comprising:

a sole body being elastic, the sole body having a receiving space being open, the sole body having a sealing film, the sealing film sealing the receiving space, the sole body having a plurality of supporters formed at a top side thereof, the sole body and the supporters formed as one piece, the supporters extended from a bottom side of the sole body to the receiving space at the top side of the sole body, each supporter having a bottom groove defined therein, each supporter having an inner wall and an outer wall, the outer wall of each supporter abutting against the sealing film at one end thereof;

an air valve set assembled in the receiving space, the air valve set having a main valve, a sub valve and at least one air duct, the main valve and the sub valve in the receiving space spaced from each other, so as to define a first air chamber, a second air chamber and an air admission room located between the first air chamber and the second air chamber, one of the main valve and the sub valve having an air admission pipe and an air exhaust pipe, another of the main valve and the sub valve having a sub air exhaust pipe, the air admission pipe communicating with the air admission room and the first air chamber, or the air admission pipe communicating with the air admission room and the second air chamber, the air duct connected to the air exhaust pipe at one end thereof, another end of the air duct connected to the sub air exhaust pipe, so as to make the air flowable between the first air chamber and the second air chamber; and the main valve further having an air jet pipe; the sub valve further having a sub air jet pipe; an air ejection pipe being assembled at one supporter in the second air chamber; the sole body further having an air bleeding pipe; the air bleeding pipe communicating with the air jet pipe, the sub air jet pipe and the air ejection pipe, so that the air in the sole body exhausts from the sole body;

wherein, the air flows into the first air chamber and the second air chamber via the air admission pipe and a motion of a foot.

2. The sole device with air cushion function as claimed in claim 1, wherein the supporters at the first air chamber are defined as springs.

3. The sole device with air cushion function as claimed in claim 1, wherein the air jet pipe, the sub air jet pipe and the air ejection pipe are one-way valves.

4. The sole device with air cushion function as claimed in claim 1, wherein the air exhaust pipe and the sub air exhaust pipe are both two-way valves or are both one-way valves.

5. The sole device with air cushion function as claimed in claim 1, wherein one end of each supporter abuts against the sealing film and is defined as a flat surface.

6. The sole device with air cushion function as claimed in claim 1, wherein the sole body and the supporters are made of rubber material.

* * * * *